US006954137B2

(12) United States Patent
Stewart et al.

(10) Patent No.: US 6,954,137 B2
(45) **Date of Patent: *Oct. 11, 2005**

(54) BUILDING ALARM SYSTEM WITH SYNCHRONIZED STROBES

(75) Inventors: Albert J. Stewart, Otter River, MA (US); Lawrence G. Stanley, Templeton, MA (US)

(73) Assignee: ADT Services AG, Schaffhausen (CH)

( * ) Notice: Subject to any disclaimer, the term of this patent is extended or adjusted under 35 U.S.C. 154(b) by 37 days.

This patent is subject to a terminal disclaimer.

(21) Appl. No.: 10/719,145

(22) Filed: Nov. 21, 2003

(65) Prior Publication Data

US 2004/0080401 A1 Apr. 29, 2004

Related U.S. Application Data

(63) Continuation of application No. 08/996,567, filed on Dec. 23, 1997, now Pat. No. 6,741,164, which is a division of application No. 08/682,140, filed on Jul. 17, 1996, now Pat. No. 5,886,620, which is a continuation of application No. 08/591,902, filed on Jan. 25, 1996, now Pat. No. 5,559,492, which is a continuation of application No. 08/126,791, filed on Sep. 24, 1993, now abandoned.

(51) Int. Cl.[7] ..... G08B 5/00

(52) U.S. Cl. ..... 340/332; 315/241 S; 340/286.05; 340/286.11; 340/331

(58) Field of Search ..... 340/286.05, 286.11, 340/326, 330, 331, 332, 333, 908.1, 908; 315/312, 130, 241 S, 200 A, 241 R

(56) References Cited

U.S. PATENT DOCUMENTS 3,519,984 A 7/1970 Zychal
3,648,105 A 3/1972 Sanford
3,676,736 A 7/1972 Starer (Continued)

OTHER PUBLICATIONS

*Life Alarm Fire Alarm Systems, Annunciators 4100 Series*, Simplex Time Recorder Co., Publication S4100–0004 25M Apr. 1990.

*Life Alarm Fire Alarm Systems, Voice Communications 4100 Series, Fire and Voice Control Panel*, Simplex Time Recorder Co., Publication S4100–0003–3 Jul. 1991.

*Life Alarm Multiplex Systems, 4100 Microprocesor Based Universal Transponder*, Simplex Time Recorder Co., Publication S4100–0006 Jul. 1991.

*Life Alarm Multiplex Systems, Transponder 2120–Series*, Simplex Time Recorder Co., Publication S2120–0022–5 15M Aug. 1990.

*Fire Alarm Systems, Serial LED Annunciator Cabinet*, Simplex Time Recorder Co., Publication S4602–0002 2M Apr. 1989.

*Life Alarm Fire Alarm Systems, 4100 Microprocessor Based Monitoring and Control System*, Simplex Time Recorder Co., Publication S4100–0001–4 Nov. 1990.

(Continued)

*Primary Examiner*—Brent A. Swarthout

(57) ABSTRACT

In a building fire alarm system, the light strobes of a network of strobes are synchronized to flash simultaneously. Each strobe has a charging circuit to charge a capacitor which discharges through a flash tube. Once a capacitor is charged, the charging circuit is disabled. A synchronization pulse is applied through common power lines to trigger discharge of each strobe capacitor through the flash tube followed by recharging of the capacitor.

12 Claims, 3 Drawing Sheets

U.S. PATENT DOCUMENTS

| | | | |
|---|---|---|---|
| 3,781,853 | A | 12/1973 | Jacobs |
| 3,810,170 | A | 5/1974 | Zinmeister |
| 3,846,672 | A | 11/1974 | Doughty |
| 3,873,962 | A | 3/1975 | Eggers et al. |
| 3,881,130 | A | 4/1975 | Stiller |
| 3,973,168 | A | 8/1976 | Kearsley |
| 4,004,184 | A | 1/1977 | Ott |
| 4,101,880 | A | 7/1978 | Haus |
| 4,132,983 | A | 1/1979 | Shapiro |
| 4,216,413 | A | 8/1980 | Plas |
| 4,233,546 | A | 11/1980 | Berthiaume |
| 4,329,677 | A | 5/1982 | Markl |
| 4,365,238 | A | 12/1982 | Kollin |
| 4,389,632 | A | 6/1983 | Seidler |
| 4,404,498 | A | 9/1983 | Spiteri |
| 4,499,453 | A | 2/1985 | Right |
| 4,531,114 | A | 7/1985 | Topol et al. |
| 4,613,847 | A | 9/1986 | Scolari et al. |
| 4,755,792 | A | 7/1988 | Pezzolo et al. |
| 4,796,025 | A | 1/1989 | Farley et al. |
| 4,827,245 | A | 5/1989 | Lipman |
| 4,881,058 | A | 11/1989 | Berry, III |
| 4,952,906 | A | 8/1990 | Buyak et al. |
| 4,967,177 | A | 10/1990 | Nguyen |
| 5,019,805 | A | 5/1991 | Curl et al. |
| 5,121,033 | A | 6/1992 | Kosich |
| 5,128,591 | A | 7/1992 | Bocan |
| 5,196,766 | A | 3/1993 | Beggs |
| 5,341,069 | A | 8/1994 | Kosich et al. |
| 5,400,009 | A | 3/1995 | Kosich et al. |
| 5,598,139 | A | 1/1997 | Karim et al. |
| 5,608,375 | A | 3/1997 | Kosich |
| 5,751,210 | A | 5/1998 | Kosich |

OTHER PUBLICATIONS

*Life Alarm Fire Alarm Systems, 4100 Microprocessor Based Monitoring and Control System*, Simplex Time Recorder Co., Publication S4100–0001–1 5M Nov. 1988.

"Everything You Always Wanted to Know About Flashtubes," Anchor Engineering Corporation, Westborough, MA, pp. 1–12.

Drell, A., "Strobe Alarm Branded Danger to Epileptics," *Metro*, 1 pg.

BUILDING ALARM SYSTEM WITH SYNCHRONIZED STROBES

RELATED APPLICATIONS

This is a Continuation Application of U.S. application Ser. No. 08/996,567, filed Dec. 23, 1997, now U.S. Pat. No. 6,741,164, which is a Divisional Application of U.S. application Ser. No. 08/682,140, filed Jul. 17, 1996, now U.S. Pat. No. 5,886,620, which is a Continuation Application of U.S. application Ser. No. 08/591,902, filed on Jan. 25, 1996, now U.S. Pat. No. 5,559,492, which is a File Wrapper Continuation of U.S. application Ser. No. 08/126,791, filed on Sep. 24, 1993 now abandoned, the entire teachings of which are incorporated herein by reference.

BACKGROUND OF THE INVENTION

Typical building fire alarm systems include a number of fire detectors positioned through a building. Signals from those detectors are monitored by a system controller which, upon sensing an alarm condition, sounds audible alarms throughout the building. Flashing light strobes may also be positioned throughout the building to provide a visual alarm indication, with a number of audible alarms and strobes typically being connected between common power lines in a network. A first polarity DC voltage may be applied across those power lines in a supervisory mode of operation. In the supervisory mode, rectifiers at the alarm inputs are reverse biased so that the alarms are not energized, but current flows through the power lines so that the condition of those lines can be monitored. With an alarm condition, the polarity of the voltage applied across the power lines is reversed to energize all alarms on the network.

Typical strobes are xenon flash tubes which discharge very high voltages in the range of about 250 volts. Those high voltages are reached from a nominal 24 volt DC supply by charging a capacitor in increments with a rapid sequence of current pulses to the capacitor through a diode from an oscillator circuit. When the voltage from the capacitor reaches the level required by the flash tube, a very high voltage trigger pulse of between 4,000 and 10,000 volts is applied through a step-up transformer to a trigger coil about the flash tube. The trigger pulse causes the gas in the tube to ionize, drawing energy from the capacitor through the flash tube to create the light output.

Under the American Disability Act, and as specified in Underwriters Laboratories Standard UL 1971, the strobes must provide greater light intensity in order that the strobes can alone serve as a sufficient alarm indication to hearing impaired persons. Unfortunately, the strobes at the higher intensity levels have been reported to trigger epileptic seizures in some people.

SUMMARY OF THE INVENTION

In typical strobe systems, each strobe fires as the required firing voltage on the capacitor is reached. Since the strobes are free-running and tolerances dictate that the time constants of various strobes are not identical, the strobes appear to flash at random relative to each other. It is believed that a high apparent flash rate that results from the randomness of the high intensity strobes causes the epileptic seizures.

In accordance with the present invention, all strobes on a network are synchronized such that they all fire together at a predetermined safe frequency to avoid causing epileptic seizures. Additional timing lines for synchronizing the strobes are not required because the synchronizing signals are applied through the existing common power lines.

Accordingly, in a building alarm system having a plurality of warning strobes powered through common power lines, each strobe includes a flash lamp and a capacitor to be discharged through the flash lamp. A charging circuit powered by the common power lines applies a series of current pulses to the capacitor to charge the capacitor. The firing circuit responds to a change in voltage across the power lines to discharge the capacitor through the flash lamp.

In order to avoid overcharging of the capacitor as a strobe waits for the firing signal, each strobe further includes a voltage sensor for disabling the charging circuit when the capacitor reaches a firing voltage level.

In a preferred system, a network operates in a supervisory mode in which current flows from a system controller through the power lines to assure the integrity of the network during nonalarm conditions. Further, during an alarm condition, the system controller may code the synchronizing signals so that the timing of the flashing strobes indicates the location in the building at which the alarm condition was triggered.

BRIEF DESCRIPTION OF THE DRAWINGS

The foregoing and other objects, features and advantages of the invention will be apparent from the following more particular description of preferred embodiments of the invention, as illustrated in the accompanying drawings in which like reference characters refer to the same parts throughout the different views.

DETAILED DESCRIPTION OF A PREFERRED EMBODIMENT

Figure 1:
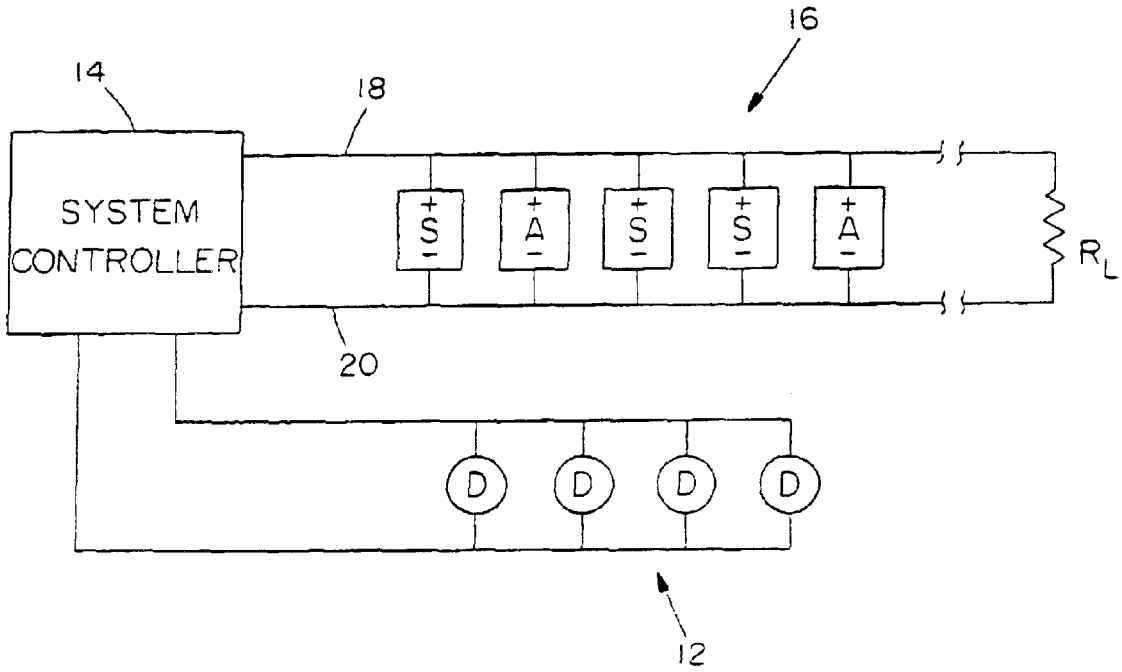
FIG. 1 illustrates an alarm system embodying the present invention.

A system embodying the present invention is illustrated in FIG. 1. As in a conventional alarm system, the system includes one or more detector networks 12 having individual fire detectors D which are monitored by a system controller 14. When an alarm condition is sensed, the system controller signals the alarm through at least one network 16 of alarm indicators. The alarm indicators may include any variety of audible alarms A and light strobe alarms S. As shown, all of the alarms are coupled across a pair of power lines 18 and 20, and the lines 18 and 20 are terminated at a resistance $R_L$.

Each of the alarms A and S includes a rectifier at its input which enables it to be energized with only one supply polarity as indicated. When there is no alarm condition, the network 16 may be monitored by applying a reverse polarity DC voltage across the network. Specifically, line 20 would be positive relative to line 18. Due to the rectifiers within the alarm devices, no alarm would be sounded, but current would still flow through the resistor $R_L$. Any fault in the lines 18 and 20 would prevent that current flow and would be recognized as a fault by the system controller. With an alarm condition, the system controller would apply power across lines 18 and 20 with a positive polarity to cause all alarms to provide their respective audible and visual indications.

Figure 2:
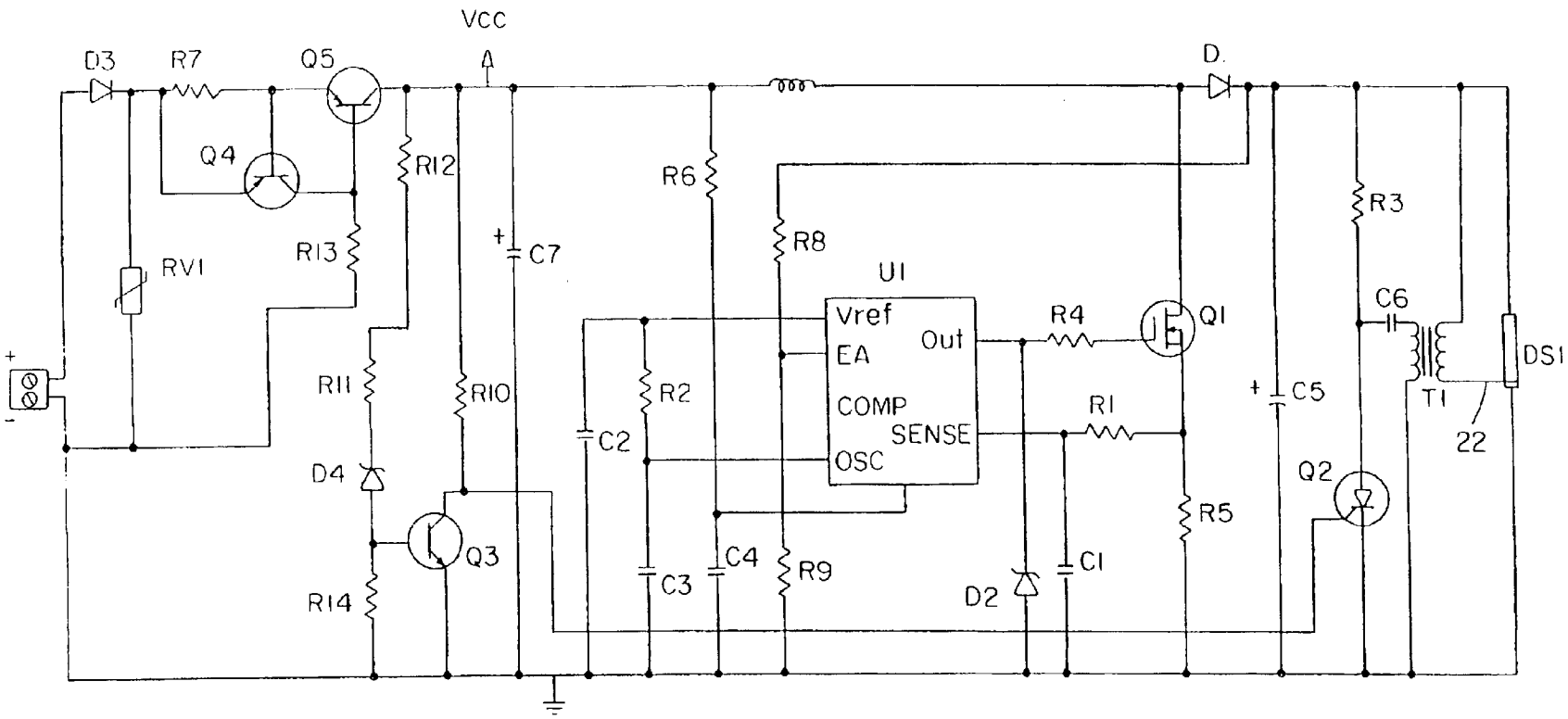
FIG. 2 is a detailed electrical schematic of a strobe in the system of FIG. 1.

A preferred circuit of a light strobe S is presented in FIG. 2. Line 18 is coupled through the diode rectifier D3 so that the strobe only responds to a positive polarity voltage across the lines 18 and 20 as discussed above. Diode D3 is followed by a noise spike suppression metal oxide varistor RV1 and a current regulator of transistors Q4 and Q5. During normal current flow, Q5 is biased on through resistors R7 and R13. The current flow thus maintains a charge Vcc across capacitor C7. However, during an in-rush situation such as during start-up, the several alarm circuits may draw too much current and overload the power supply. In situations of high current, the higher voltage across resistor R7 turns transistor Q4 on, which in turn turns Q5 off.

Zener diode D4 and transistor Q3 are part of a flash tube trigger circuit to be discussed further below. At normal values of Vcc, nominally 24 volts, zener diode D4 is turned on through resistors R11 and R12. The resultant voltage across R14 turns Q3 on to pull the node below resistor R10 to ground. With that node grounded, the silicon controlled rectifier Q2 to the right of the circuit remains off.

The overall function of the circuit is to charge a capacitor C5 to a level of about 250 volts and periodically discharge that voltage through a flash tube DS1 as a strobe of light. The flash tube is triggered by applying a high voltage in the range of 4,000 to 10,000 volts through a trigger coil connected to line 22. That very high voltage is obtained from the 250 volts across C5 through a transformer T1. Specifically, when SCR Q2 is gated on, the node below resistor R3 rapidly changes from 250 volts to 0 volts. That quick change in voltage passes a voltage spike through the differentiating capacitor C6 which is transformed to a 4,000 to 10,000 volt pulse on line 22.

Capacitor C5 is charged in incremental steps with a rapid series of current pulses applied through diode D1. To generate those current pulses, a UC3843A pulse width modulator is used in an oscillator circuit. The oscillating output of the pulse width modulator is applied through resistor R4 to switch Q1. Zener diode D2 serves to limit the voltage output of the pulse width modulator. When Q1 turns on, current is drawn through the inductor L1. The output of the modulator goes low when a predetermined voltage is sensed across resistor R5 through resistor R1 and capacitor C1. When Q1 is then switched off, the collapsing field from inductor L1 drives a large transient current through diode D1 to incrementally charge C5.

The pulse width modulator is powered through resistor R6 and capacitor C4. The frequency of oscillations of the modulator U1 are controlled by resistor R2 and capacitors C2 and C3.

The voltage across capacitor C5 is sensed by voltage divider resistors R8 and R9. When that voltage reaches a predetermined level such as 250 volts, the pulse width modulator U1 is disabled through its EA input. This prevents overcharging of capacitor C5 while the strobe circuit waits for a synchronizing pulse at its input.

Figure 3:
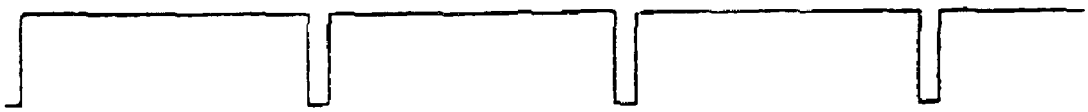
FIG. 3 is a timing diagram illustrating the synchronization signals on the power lines.

FIG. 3 illustrates the signal across lines 18 and 20 during an alarm condition. Normally, the voltage is high so that the charging circuit charges the capacitor C5 to 250 volts and then holds that voltage. Periodically, however, the voltage across the power lines goes low as illustrated. For example, the voltage might drop to zero for ten milliseconds every 2.4 seconds. That voltage drop is not perceived in the audible alarms, but is sufficient to trigger the strobes. As the voltage goes low, zener diode D4 stops conducting and transistor Q3 turns off. There remains, however, sufficient voltage on capacitor C7 to raise the voltage between Q3 and R10 to a level sufficient to gate the SCR Q2 on. With SCR Q2 on, the trigger pulse is applied to line 22 so that capacitor C5 is discharged through the flash lamp. Subsequently, when the power supply voltage is returned to its normal level, the charging circuit including modulator U1 recharges capacitor C5 to the 250 volt level.

Prior strobes have been free running, an equivalent to capacitor C5 being discharged as it reached the 250 volt level. Thus, timing of the strobe flash was dictated solely by the charging time constant of the particular circuit, and strobes flashed at different intervals. The circuit disclosed enables the synchronization of the entire network of strobes, and does so without the need for a separate synchronization line. Synchronization is obtained by triggering all strobes of a network with a pulse in the power supply. The circuit is able to respond to the synchronization signal in the power lines without loss of the ability to supervise the network over those same two power lines during the supervisory mode of operation. Thus, the two lines provide supervisory current to monitor for faults, power to the audible and visual alarms during an alarm condition, and synchronization of the strobes.

Circuitry is no more complicated than would be a free running strobe. In fact, the circuit of FIG. 2 can be readily converted to a free running strobe by removing the resistor R12 and applying a gating voltage above R11 from a COMP output of the modulator U1. The COMP output goes high with sensing of the desired voltage level at input EA.

In the past, audible alarms have been coded in their audible outputs to indicate, for example, the source of the alarm condition. For example, an alarm output of two beeps followed by three beeps followed by seven beeps could indicate that the alarm condition was triggered at room 237. By synchronizing all strobes in accordance with the present invention, encoding of the strobe alarm signal can also be obtained. The system controller need only time the synchronization pulses accordingly. When the network includes audible alarms, the fall in voltage which ends an audible beep triggers the flash.

While this invention has been particularly shown and described with references to preferred embodiments thereof, it will be understood by those skilled in the art that various changes in form and details may be made therein without departing from the spirit and scope of the invention as defined by the appended claims.

What is claimed is:

1. A method of synchronizing audible alarms and visual strobes comprising:

connecting the audible alarms and visual strobes to common power lines;

for each visual strobe, providing a capacitor carrying a charge to be discharged through the visual strobe and a charging circuit powered from the power lines to charge the capacitor to a firing voltage level that is maintained without activating the strobe;

applying power to the audible alarms and visual strobes through the common power lines; and thereafter, changing the voltage on the power lines to control timing of the audible alarms and visual strobes, the strobes being triggered to flash with the change in voltage on the power lines.

2. The method of claim 1 wherein the change in voltage that triggers the strobes ends an audible alarm.

3. The method of claim 1 further comprising powering the visual strobes to charge the capacitor in each strobe; and wherein the step of changing the voltage on the power lines includes providing a synchronization signal through the power lines to cause each strobe to discharge the capacitor through a flash lamp in each strobe such that the strobes flash in synchronization with each other.

4. The method of claim 3 further comprising controlling timing of the strobes to provide an encoded visual output.

5. An alarm system comprising:

a pair of power lines;

at least one audible alarm powered by the power lines; and at least one visual strobe powered by the power lines, the strobe comprising:

a capacitor for carrying a charge to be discharged through the strobe; and a charging circuit powered from the power lines to charge the capacitor to a firing voltage level that is maintained without activating the strobe, the strobe being triggered to flash with a change in the voltage on the power lines.

6. The alarm system of claim 5 wherein the audible alarm is non-continuous and synchronized.

7. The alarm system of claim 5 wherein the change in voltage that triggers the strobe ends an audible alarm.

8. The alarm system of claim 5 further comprising a plurality of audible alarms.

9. The alarm system of claim 8 wherein the change in voltage that triggers the strobe ends an audible beep produced by the audible alarms.

10. The alarm system of claim 5 wherein the change in voltage includes an interruption in power.

11. A method of synchronizing audible alarms and visual strobes comprising:

connecting the audible alarms and visual strobes to common power lines and applying power to the audible alarms and visual strobes through the common power lines;

at each strobe, charging a capacitor to a firing level that is maintained without activating the strobe; and after the audible alarms and visual strobes have been powered, repeatedly changing the voltage on the power lines to control timing of the audible alarms and visual strobes, the capacitors being discharged through the visual strobes.

12. The method of claim 11 wherein a change in voltage that triggers the strobes ends an audible beep produced by the audible alarms.

* * * * *